US010806253B2

(12) United States Patent
Stocker

(10) Patent No.: US 10,806,253 B2
(45) Date of Patent: Oct. 20, 2020

(54) WALL SHELF SYSTEM

(71) Applicant: DIY Element System GmbH, Rottenacker (DE)

(72) Inventor: Josef Stocker, Herbertshofen (DE)

(73) Assignee: DIY ELEMENT SYSTEM GMBH (DE)

( * ) Notice: Subject to any disclaimer, the term of this patent is extended or adjusted under 35 U.S.C. 154(b) by 166 days.

(21) Appl. No.: 16/045,208

(22) Filed: Jul. 25, 2018

(65) Prior Publication Data

US 2019/0038023 A1 Feb. 7, 2019

(30) Foreign Application Priority Data

Aug. 2, 2017 (EP) ..... 17184483

(51) Int. Cl.
*A47B 57/42* (2006.01)
*A47B 9/06* (2006.01)
(Continued)

(52) U.S. Cl.
CPC ..... *A47B 57/42* (2013.01); *A47B 47/022* (2013.01); *A47B 88/407* (2017.01); *A47B 88/437* (2017.01); *A47B 96/024* (2013.01); *A47B 96/061* (2013.01); *A47F 5/0093* (2013.01); *A47B 88/43* (2017.01); *A47B 96/028* (2013.01); *A47B 2088/401* (2017.01); *A47B 2210/04* (2013.01); *A47F 3/06* (2013.01)

(58) Field of Classification Search
CPC ..... A47B 57/42; A47B 88/407; A47B 88/437; A47B 47/022; A47B 96/024; A47B 96/061; A47B 88/43; A47B 2088/401; A47B 2210/04; A47B 96/02; A47B 96/06; A47B 88/40; A47B 96/028; A47B 96/025; A47B 46/00; A47B 57/00; A47B 88/00; A47B 57/30; A47B 88/403; A47B 88/423; A47B 88/427; A47B 88/483; A47B 96/027; A47B 96/16; A47B 96/063; A47B 96/066; A47B 96/07; A47B 57/34; A47B 88/493; A47F 5/0093; A47F 3/06; A47F 5/00
USPC ..... 211/193, 90.02, 175, 126.15, 151, 103; 248/235, 241, 244, 250, 248, 247; 108/106–108; 312/334.18, 334.19, 312/334.43, 334.41
See application file for complete search history.

(56) References Cited

U.S. PATENT DOCUMENTS 813,501 A * 2/1906 Keil ..... A47B 57/42 248/243
2,681,786 A * 6/1954 Sparring ..... A47B 57/42 248/243
(Continued)

OTHER PUBLICATIONS

Official Communication from European Patent Office for related European Patent Application No. 17184483.0; dated: Nov. 20, 2017; 9 pages.

*Primary Examiner* — Jennifer E. Novosad
(74) *Attorney, Agent, or Firm* — Dickinson Wright PLLC

(57) ABSTRACT

A wall shelf system having a shelf bracket comprising a rear end for fastening to a wall rail, a front end, and at least one first side wall, and having a guide rail for a shelf element that can be pulled out and comprising a rear end, a front end, and a side wall. Coupling features are provided at the shelf bracket and at the guide rail that correspond to one another and that enable the guide rail to be releasably fastened to the shelf bracket.

16 Claims, 10 Drawing Sheets

Figures 1A, 1B, 1C, 1D:
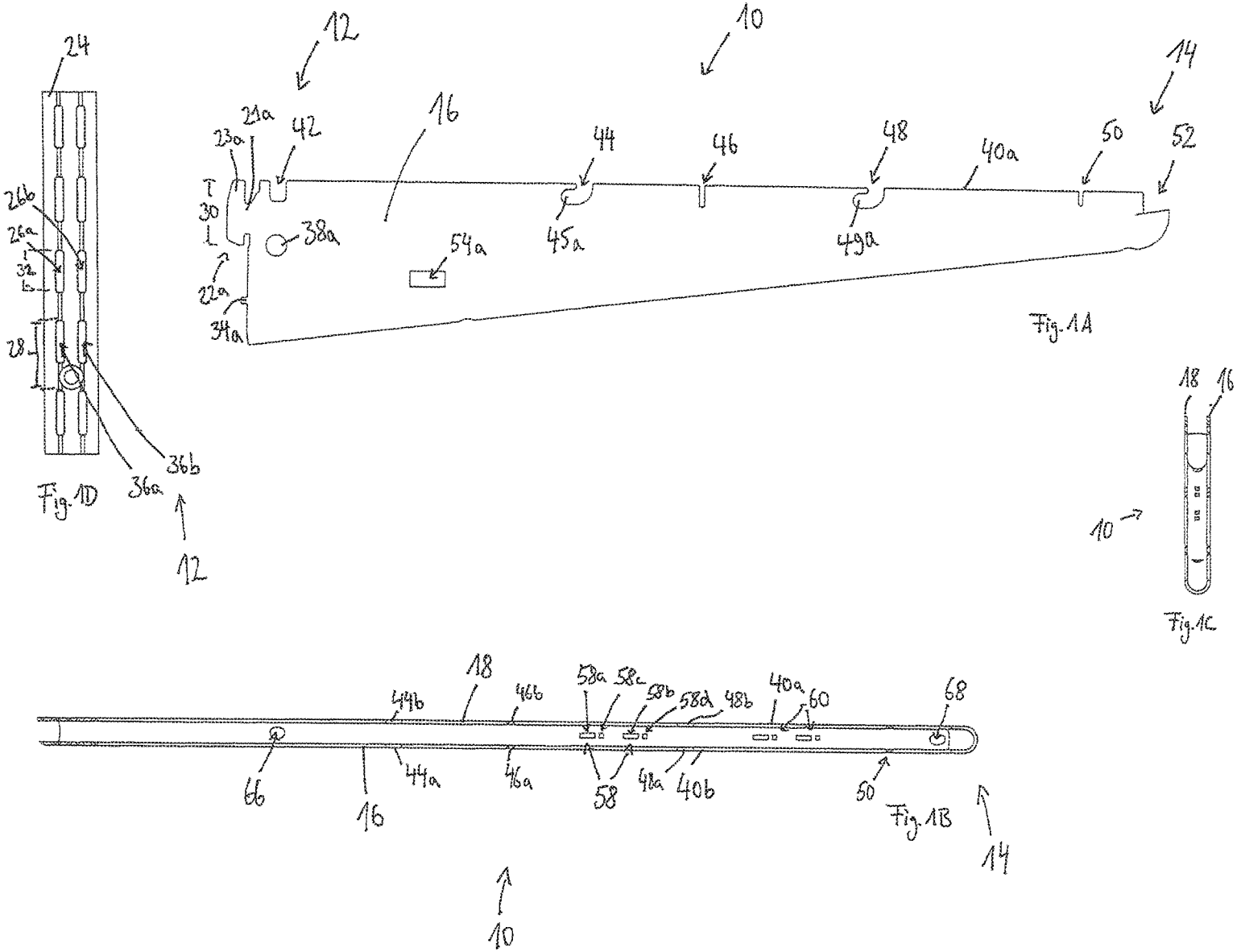

(51) Int. Cl.

| | |
|---|---|
| ***A47F 5/00*** | (2006.01) |
| ***A47B 96/02*** | (2006.01) |
| ***A47B 88/407*** | (2017.01) |
| ***A47B 88/437*** | (2017.01) |
| ***A47B 47/02*** | (2006.01) |
| ***A47B 88/43*** | (2017.01) |
| ***A47B 88/40*** | (2017.01) |
| ***A47F 3/06*** | (2006.01) |
| ***A47B 96/06*** | (2006.01) |

(56) References Cited

U.S. PATENT DOCUMENTS 3,355,134 A * 11/1967 Chesley ..... A47B 96/025 248/250
3,565,381 A * 2/1971 Oliver ..... A47B 57/42 248/243
3,984,163 A * 10/1976 Boorman, Jr. ..... A47B 46/00 312/408
4,669,692 A * 6/1987 Mastrodicasa ..... A47B 46/00 211/134
4,720,069 A * 1/1988 Bessinger ..... A47B 96/061 211/90.01
5,069,408 A * 12/1991 Bessinger ..... A47B 96/061 108/108
5,405,114 A * 4/1995 Dias ..... A47B 96/061 108/108
5,486,046 A * 1/1996 Jernstrom ..... F25D 25/02 312/408
5,592,886 A * 1/1997 Williams ..... A47B 57/52 108/108
6,019,331 A * 2/2000 Hoogland ..... A47B 96/061 108/108
6,505,800 B1 * 1/2003 Abdullah ..... A47B 96/061 135/913
6,565,168 B1 * 5/2003 Baliko ..... A47B 88/00 312/334.12
7,063,219 B2 * 6/2006 Fann ..... A47B 73/002 211/126.15
7,086,544 B1 * 8/2006 Doench ..... A47B 61/003 211/105.1
7,258,317 B1 * 8/2007 Nagel ..... A47B 96/025 108/108
7,497,344 B2 * 3/2009 Chen ..... A47B 57/40 108/108
7,731,142 B2 * 6/2010 Chen ..... A47B 88/43 248/244
9,578,976 B2 * 2/2017 Grubbs ..... A47F 1/04
9,596,931 B1 * 3/2017 Nimgulkar ..... A47B 88/49
10,098,460 B1 * 10/2018 Brinton, Jr. ..... A47B 96/145
2004/0020884 A1 * 2/2004 Magnusson ..... A47B 96/028 211/90.01
2004/0104322 A1 * 6/2004 Hennequin ..... H02G 3/0443 248/241
2004/0108427 A1 * 6/2004 Chen ..... A47B 57/40 248/244
2004/0182804 A1 * 9/2004 Harper ..... A47B 96/021 211/90.02
2004/0263033 A1 * 12/2004 Kish ..... A47B 88/43 312/334.1
2007/0221597 A1 9/2007 Chen
2009/0139943 A1 * 6/2009 Fernandez ..... A47B 45/00 211/94.01
2010/0213334 A1 * 8/2010 Davenport ..... A47B 57/16 248/220.21
2014/0034591 A1 2/2014 Szpak et al.
2019/0038023 A1 * 2/2019 Stocker ..... A47B 96/061
2019/0110593 A1 * 4/2019 Nilsson ..... A47B 96/028
2019/0298059 A1 * 10/2019 Chen ..... A47B 88/407

* cited by examiner 10
12
14
16
18
21a
22a
23a
24
24b
26a
28
30
32
34a
36a
36b
38a
40a
40b
42
44
44a
44b
45a
46
46a
46b
48
48a
48b
49a
50
52
54a
58
58a
58b
58c
60
66
68

84
50
104
86
76
74
78
58
102
18
16
22b
22a 84
104
56'
16
18

92
94
94a
96
96a
98
100
106

WALL SHELF SYSTEM

The present invention relates to a wall shelf system having a shelf bracket that has a rear end for fastening to a wall rail, a front end, and a first side wall and having a guide rail for a shelf element that can be pulled out and that has a rear end, a front end, and a side wall.

Shelf brackets that have a guide rail for a shelf element are generally known from the prior art. Shelf brackets are, for example, known at which a guide groove is shaped and the shelf bracket thus itself forms the guide rail. Shelf brackets are also known to which a guide rail is welded.

All these shelf brackets have the disadvantage that they are limited in their area of application. In known wall shelf systems, at least two kinds of shelf brackets are therefore always offered, some with a guide rail and some without a guide rail.

It is the underlying object of the invention to provide a wall shelf system that is adaptable in as individual a manner as possible and that manages with a universally usable shelf bracket.

The object is satisfied by a wall shelf system having the features of claim 1 and in particular n that coupling means are provided at the shelf bracket and in that coupling means corresponding to the coupling means of the shelf bracket are provided at the guide rail to releasably fasten the guide rail to the shelf bracket.

It is the general idea underlying the invention to provide a releasable connection between the shelf bracket and the guide rail to obtain a selection possibility as to whether the shelf bracket with the guide rail or without the guide rail should be used.

Advantageous embodiments can be found in the dependent claims, in the description and in the drawings.

In accordance with an embodiment, the coupling means of the shelf bracket are arranged at the side wall of the shelf bracket. Alternatively or additionally, the coupling means of the guide rail can be arranged at the side wall of the guide rail. This has the advantage that the wall shelf system can be designed as compact and the connection between the shelf bracket and the guide rail can be designed as stable.

A particularly secure connection between the shelf bracket and the guide rail is achieved when the coupling means enable a shape-matched connection between the shelf bracket and the guide rail. Alternatively, a purely force-transmitting connection can, for example, be made possible by the coupling means by means of one or more magnets. It is also conceivable that the coupling means enable a combination of a shape-matched connection and a force-transmitting connection.

In accordance with an embodiment, the coupling means are formed in the side wall of the shelf bracket and/or of the guide rail and/or they project from the side wall of the shelf bracket and/or of the guide rail. The coupling means in particular comprise recesses and/or hooks or lugs bent out of the shelf bracket and/or of the guide rail. Such shaped coupling means have the advantage that they can be produced favorably and simultaneously with high quality.

In accordance with an embodiment that is particularly simple to assemble and to dismantle, the coupling means enable a fixing and/or release of the guide rail without tools. A fixing and release without tools is possible when a user of the wall shelf system can fasten the guide rail to the shelf bracket and can release it therefrom without requiring tools such as a screwdriver or a hammer for this purpose.

Such a fixing and release of the guide rail without tools can be made possible, for example, by means of a push-lock connection between the guide rail and the shelf bracket. A push-lock connection comprises a push connection in which a first coupling means is inserted into a second coupling means formed as an opening or recess and in particular complementary. The push-lock connection additionally comprises a lock connection in which a first coupling means mechanically latches with a second coupling means. Such push-lock connections have the advantage that they can be intuitively understood by the user since they easily reveal how the shelf bracket and the guide rail should be connected to one another.

The coupling means can have at least one cut-out and/or at least one hook-shaped section. The coupling means can in particular comprise two or more cut-outs and/or two or more hook sections. The at least one cut-out and the at least one hook section can be arranged with respect to one another at the shelf bracket and at the guide rail such that the hook section can engage into the cut-out and thereby holds the guide rail at the position intended for it at the shelf bracket.

In accordance with a preferred embodiment, the coupling means of the shelf bracket comprise two cut-outs, with one of the cut-outs being formed by a hole in the side wall of the shelf bracket and the other cut-out being formed by a slit that extends from an upper margin of the shelf bracket into the shelf bracket. The coupling means of the guide rail comprise at least two hook sections corresponding to the cut-outs, with the one hook section being able to be arranged in a central region of the side wall of the guide rail and the other hook section being able to be arranged in an upper marginal region of the side wall of the guide rail. A push-lock connection that be manufactured particularly simply can hereby be made possible that holds the guide rail securely at the shelf bracket.

To be able to fix guide rails at both sides of the shelf bracket, it is advantageous for the shelf bracket to have two side walls which are arranged spaced apart in parallel and at whose respective outer surfaces suitable coupling means are preferably provided. If, in contrast, the shelf bracket only has one side wall, the coupling means can be provided at the oppositely disposed sides of the side wall.

The shelf bracket preferably has a U-shaped cross-section. Such a shelf bracket can, for example, be manufactured in that a metal sheet is bent over to form a U-shaped bracket. In accordance with an advantageous embodiment, the shelf bracket is only manufactured by a stamping and bending process. To increase the stability, spacers can be provided between two side wall of the shelf bracket spaced apart in parallel.

So that the shelf bracket cannot unintentionally fall out of a wall rail, the shelf bracket preferably has a security against removal at its rear end. The security against removal in particular comprises a T-shaped end section so that the shelf bracket cannot be released from the wall shelf by a blow against the shelf bracket from below. The T-shaped end section is preferably dimensioned such that a part section of the T-shaped end section extending vertically in the installation situation is longer than a corresponding opening of the wall rail which likewise extends vertically in the installation situation and into which the T-shaped end section engages.

If the shelf bracket is equipped with two side walls spaced apart in parallel, a security against removal can be provided at each of its rear ends, i.e. at each of the side walls. A respective T-shaped end section can in particular be formed at each of the rear ends of the side walls.

The wall shelf system can furthermore comprise one or more wall rails vertically placeable on a wall. They can have a plurality of openings having a constant spacing, the so-called grid dimension, from one another. The spacing between the respective lower ends of the openings is advantageously 32 mm long or 50 mm long.

To be able to fasten clothes rails between two shelf brackets, the shelf bracket is preferably provided with a mount for a clothes rail holder. A clothes rail holder matching it can correspondingly be provided that is connectable to the shelf bracket by means of the mount without tools. For this purpose, the shelf bracket is preferably of U shape and advantageously has coupling means at its lower side that cooperate with corresponding coupling means of the clothes rail holder to establish a connection between the shelf bracket and the clothes rail holder. The coupling means of the shelf bracket can in particular comprise two openings at the lower side of the shelf bracket and the coupling means of the clothes rail holder can comprise two hook-shaped end sections.

The guide rail advantageously has a C-shaped cross-section in whose inner space a guide surface for the shelf element that can be pulled out is in particular provided. The guide rail preferably as a roller that is laterally attached in the guide rail and that rolls off on the shelf element on the pulling out of the shelf element.

The guide rail preferably has a pull-out block at its front end so that the shelf element cannot be pulled too far out. It can be formed in the shape of an end abutment.

The shelf element that can be pulled out, for whose reception the guide rail is provided, can, for example, be a shelf bottom, a trouser holder, a wire basket, a tray, or the like. The shelf element is preferably provided with a pull-out rail adapted to the guide rail and guided in the guide rail for a support of the shelf element in the guide rail that is as smooth as possible.

The subject of the invention is also a shelf bracket and/or a guide rail for a wall shelf system of the above-described kind.

Figure 2A:
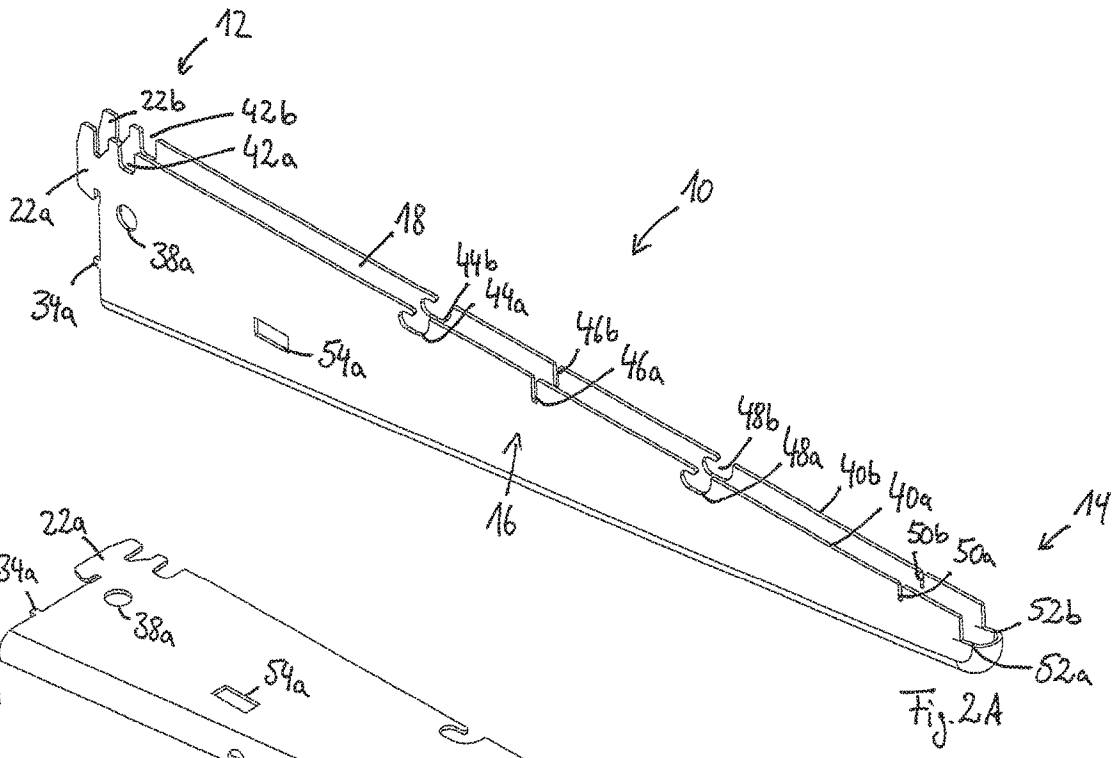
Figure 2B:
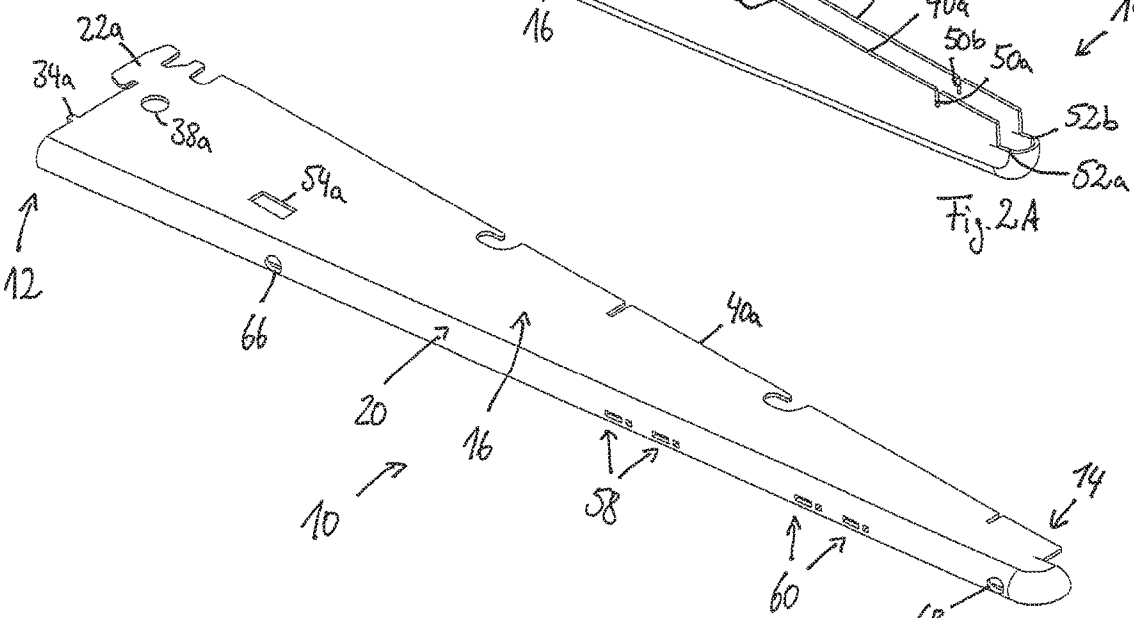
Figure 3A:
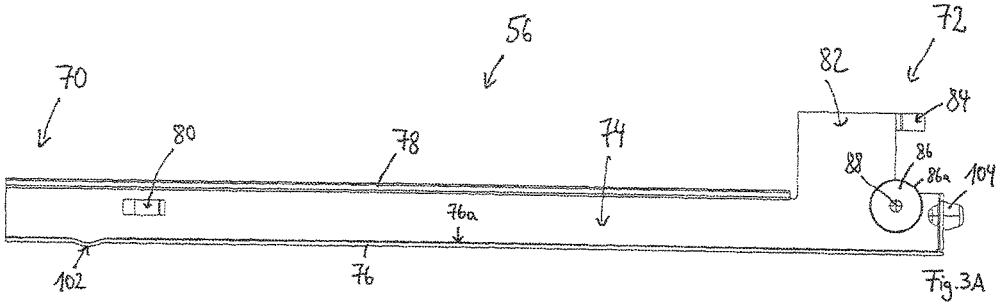
Figure 3D:
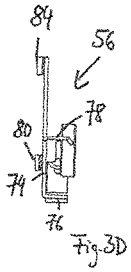
Figure 3B:
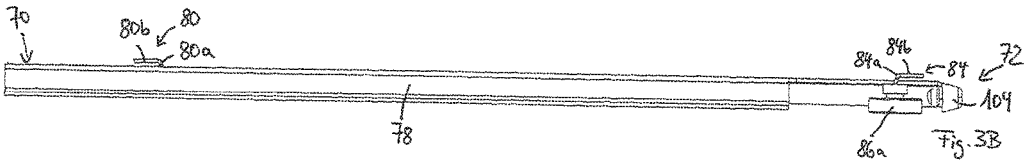
Figure 3C:
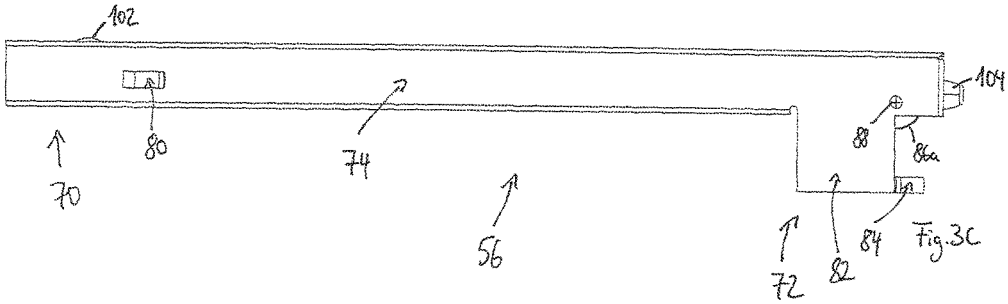
Figure 4:
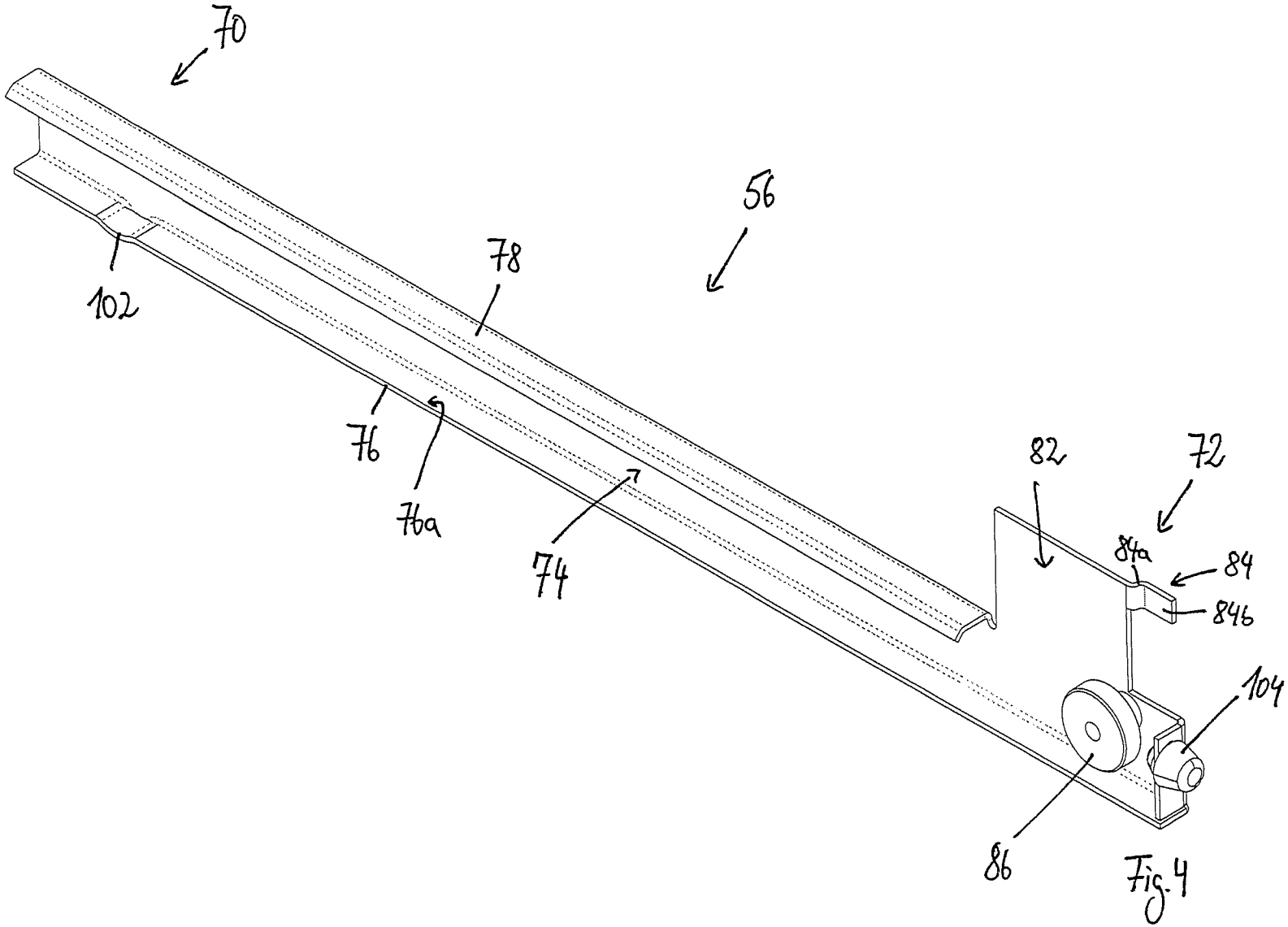
Figure 5C:
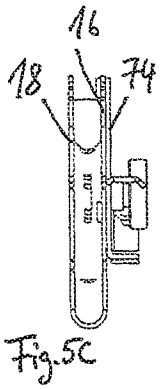
Figure 5A:
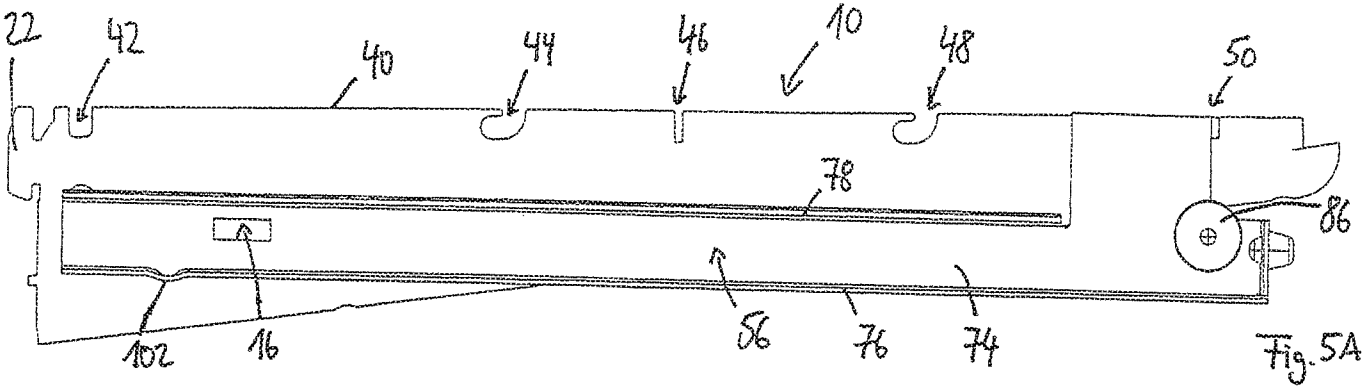
Figure 5B:
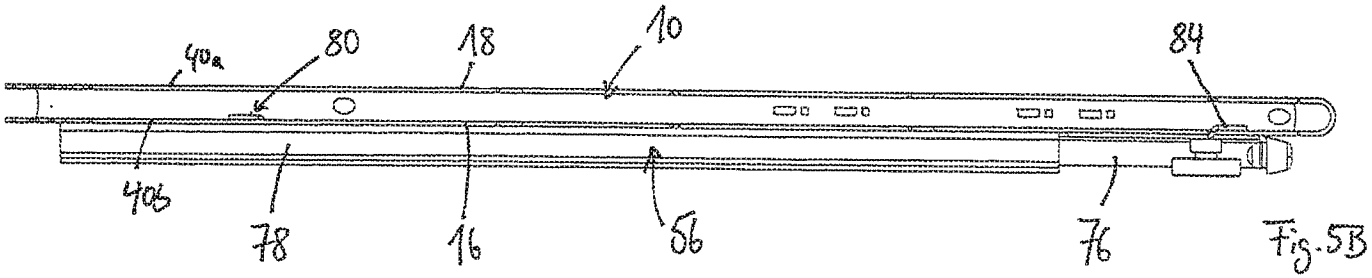
Figures 6A, 6B:
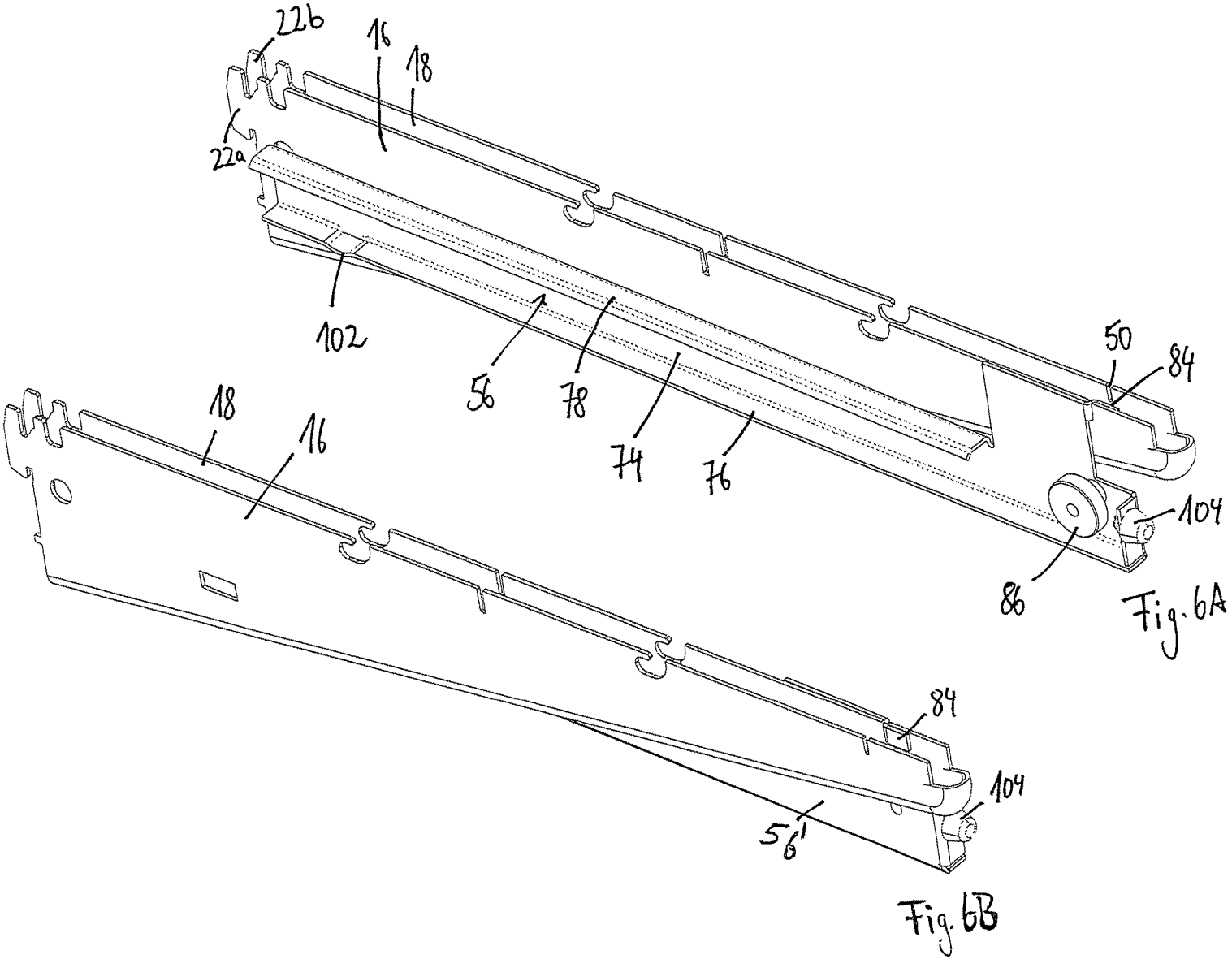
Figures 7A, 7B, 7C, 7D:
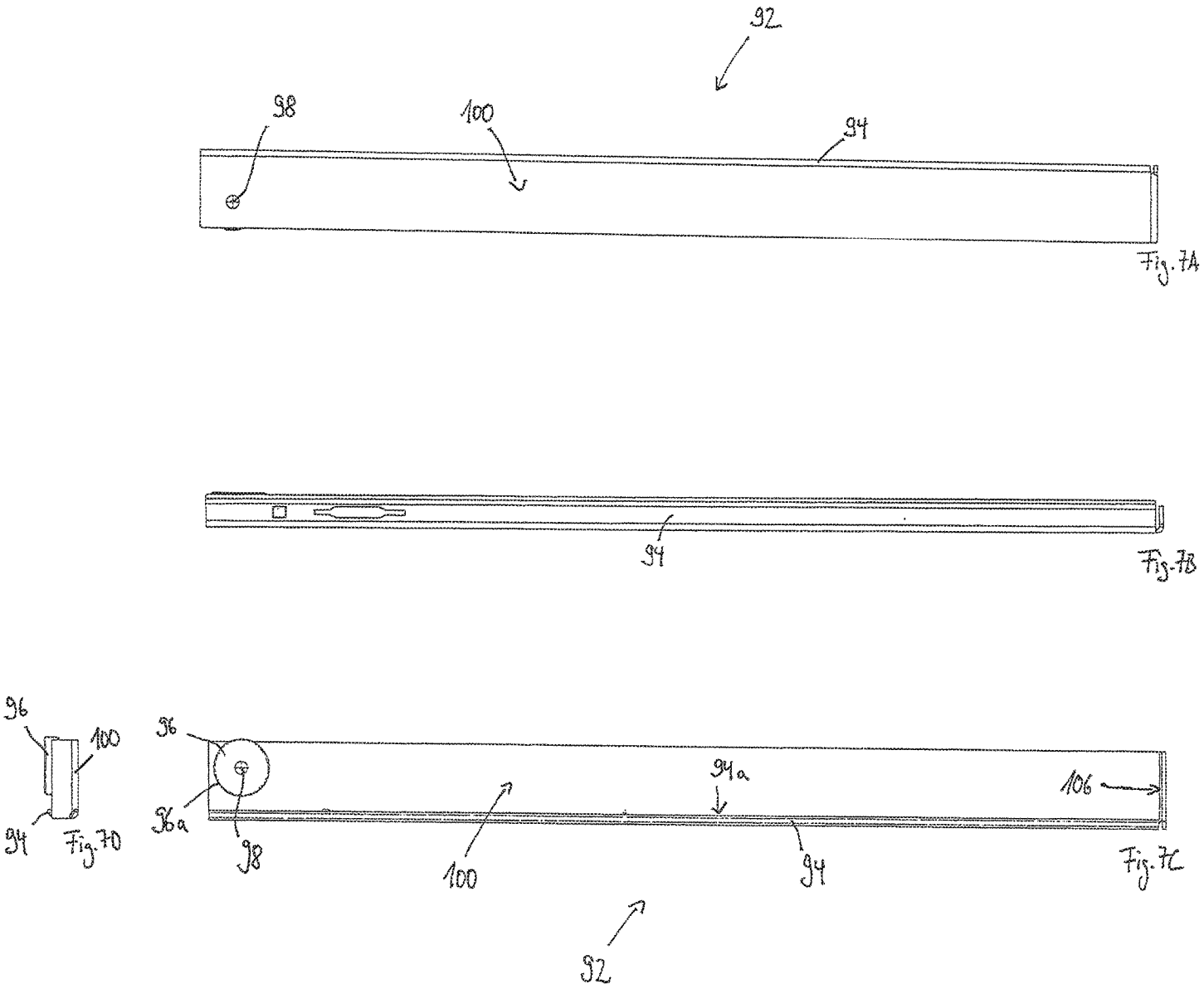
Figure 8:
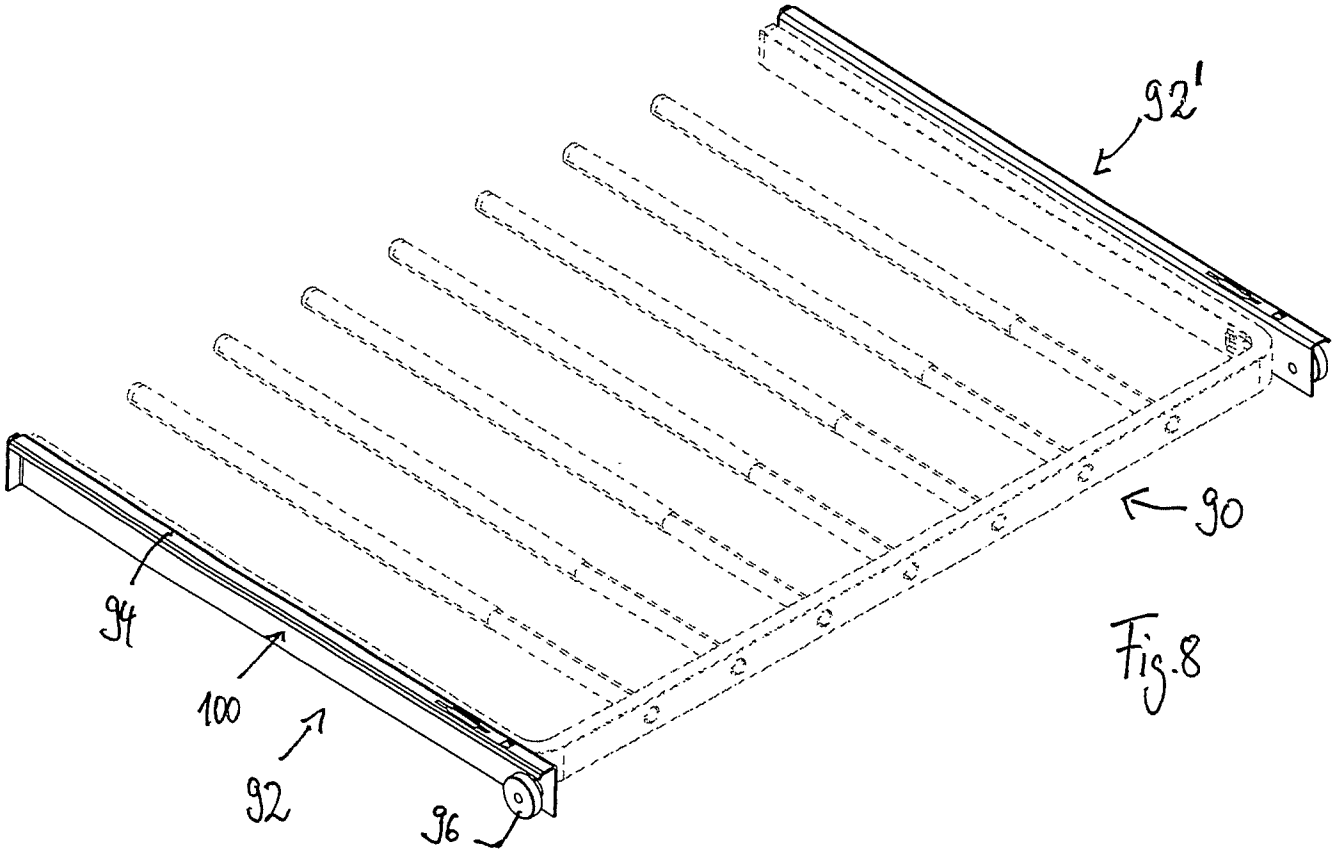
Figure 9C:
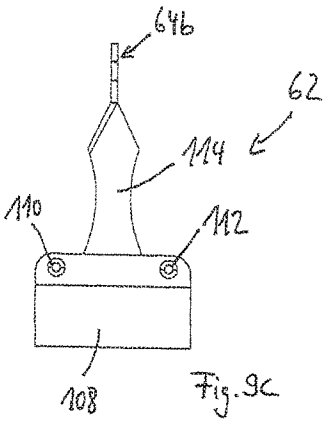
Figure 9E:
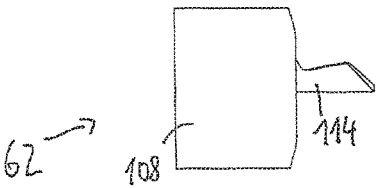
Figure 9B:
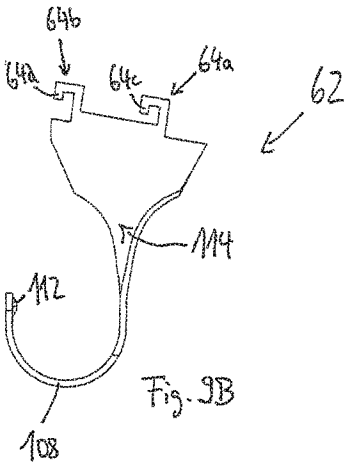
Figure 9D:
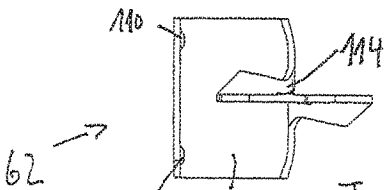
Figure 9A:
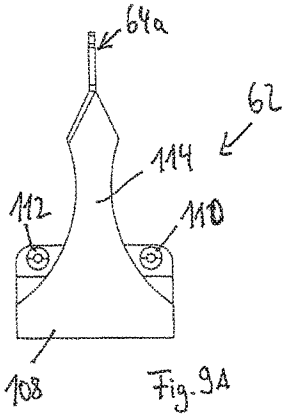

The invention will be described in the following with reference to a purely exemplary embodiment and to the enclosed drawings: There are shown:

FIG. 1A a side view of a shelf bracket in accordance with the invention;

FIG. 1B a plan view from above of the shelf bracket of FIG. 1A;

FIG. 1C a rear view of the shelf bracket of FIG. 1A;

FIG. 1D a wall rail for the shelf bracket of FIG. 1A;

FIG. 2A a perspective view obliquely from above of the shelf bracket of FIG. 1A, FIG. 2B a perspective view obliquely from below of the shelf bracket of FIG. 1A, FIG. 3A a first side view of a guide rail in accordance with the invention;

FIG. 3B a plan view of the guide rail of FIG. 3A;

FIG. 3C a second side view of the guide rail of FIG. 3A;

FIG. 3D a rear view of the guide rail of FIG. 3A;

FIG. 4 a perspective view obliquely from above of the guide rail of FIG. 3A;

FIG. 5A a side view of a shelf bracket of FIG. 1 to which a guide rail of FIG. 3 is attached;

FIG. 5B a plan view of the shelf bracket of FIG. 5A;

FIG. 5C a rear view of the shelf bracket of FIG. 5A;

FIG. 6A a perspective view obliquely from above of the shelf bracket of FIG. 5A;

FIG. 6B a perspective view obliquely from above of the shelf bracket of FIG. 1A with a guide rail mirrored with respect to the guide rail of FIG. 3A;

FIG. 7A a first side view of a pull-out rail;

FIG. 7B a plan view of the pull-out rail of FIG. 7A;

FIG. 7C a second side view of the pull-out rail of FIG. 7A;

FIG. 7D a rear view of the pull-out rail of FIG. 7A;

FIG. 8 a perspective view obliquely from above of a trouser holder to which the pull-out rail of FIG. 7A and a mirrored pull-out rail are attached at the left and right;

FIG. 9A a rear view of a clothes rail holder;

FIG. 9B a side view of the clothes rail holder of FIG. 9A;

FIG. 9C a front view of the clothes rail holder of FIG. 9A;

FIG. 9D a plan view from above of the clothes rail holder of FIG. 9A;

FIG. 9E a view from below of the clothes rail holder of FIG. 9A; and

Figure 10:
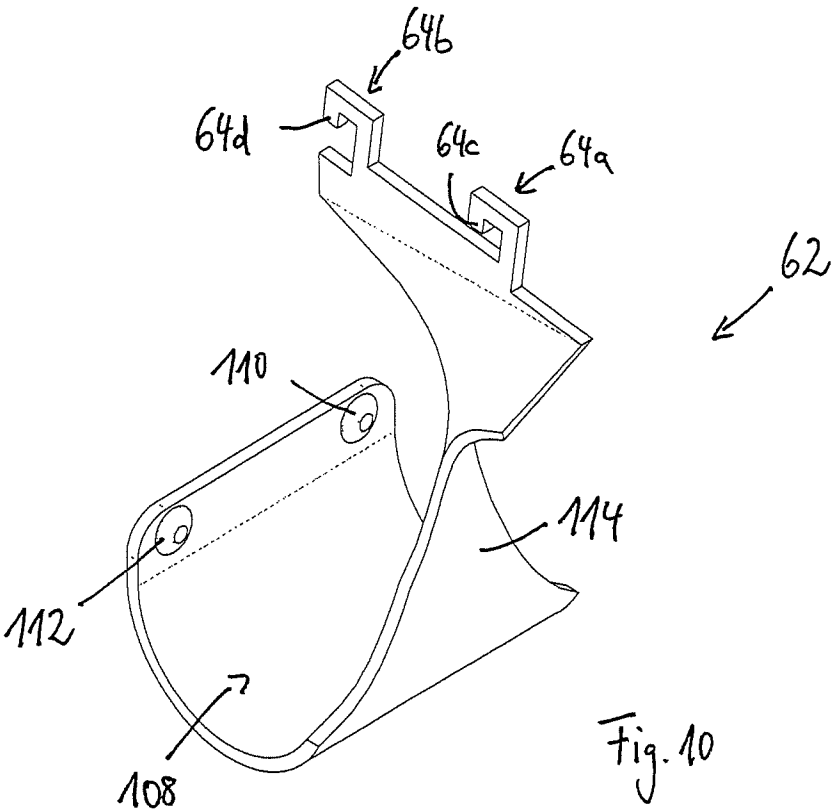

FIG. 10 a perspective view of the clothes rail holder of FIG. 9.

A shelf bracket 10 for a wall shelf is shown in the FIGS. 1A to 10, 2A and 2B. The shelf bracket 10 has a rear end 12, a front end 14, and two side walls 16, 18 spaced apart in parallel. The shelf bracket 10 is brought into a U shape by bending a metal sheet and is thereby substantially closed along a bracket bottom 20, i.e. at its lower side, and is open at its upper side. The side walls 16, 18 of the shelf bracket 10 describe a substantially triangular peripheral shape, with the shelf bracket 10 being higher in the region of its rear end 12 than in the region of its front end 14. While the upper side of the shelf bracket 10 therefor extends substantially horizontally in the installed state, the bracket bottom 20 forms a slanted surface that merges into a peripheral surface in the shape of a quadrant at the front end 14 of the shelf bracket 10.

The shelf bracket 10 has a T-shaped end section 22*a*, 22*b* at a rear end 12 of each side wall 16, 18, said T-shaped end section serving to hang the shelf bracket 10 at a wall rail 24 shown in FIG. 1D. The wall rail 24 can also be called a wall strip. Each T-shaped end section 22*a*, 22*b* is formed by a web section 21*a*, 21*b* whose length at least approximately corresponds to the wall thickness of the wall rail 24 and by a hook section 23*a*, 23*b* that projects therefrom, that extends transversely thereto, and that so-to-say forms the bar of the T-shaped end section 22*a*, 22*b*.

The wall rail 24 has a plurality of pairs of slit-shaped holes 26*a*, 26*b* along its main direction of extent which are arranged spaced apart from one another at a specific spacing 28, the so-called grid dimension. Each of the T-shaped end sections 22*a*, 22*b* has a maximum height 30 that is longer than a length 32 of the slit-shaped holes 26*a*, 26*b*. The T-shaped end sections 22*a*, 22*b* of the shelf bracket 10 can hereby only be introduced into the slit-shaped holes 26*a*, 26*b* by means of a pivot movement of the shelf bracket 10 about an axis that extends perpendicular to the planes of the side walls 16, 18. The T-shaped end sections 22*a*, 22*b* thus not only hold the shelf bracket 10 at the wall rail 24, but they additionally also form a security against removal for the shelf bracket 10. The shelf bracket 10 is thus installed at the wall rail 24 such that, with an upwardly pivoted shelf bracket 10, the upper parts of the hook sections 23*a*, 23*b* of the T-shaped end sections 22*a*, 22*b* are first introduced into the slit-shaped holes 26*a*, 26*b*; the shelf bracket 10 is then pivoted downwardly into a horizontal position so that the lower parts of the hook sections 23*a*, 23*b* are also introduced into the slit-shaped holes 26*a*, 26*b*; and finally the shelf bracket 10 is displaced downwardly along the wall rail 24 until the web sections 21*a*, 21*b* lie on lower boundaries of the slit-shaped holes 26*a*, 26*b*. Two pins 34*a*, 34*b* additionally project out of the rear side of the shelf bracket 10 that each engage into an adjacent slit-shaped hole 36*a*, 36*b* of the wall rail 24 in the installed state of the shelf bracket 10 and contribute to the security against removal. A lateral movement of the shelf bracket 10 relative to the wall rail 24 is additionally limited so that a lateral fixing and guidance of the shelf bracket 10 is effected by the pins 34*a*, 34*b* and the holes 36*a*, 36*b*.

The shelf bracket 10 furthermore has a circular hanging hole 38 in the region of its rear end 12 that extends through both side walls 16, 18 and makes it possible to hang the shelf bracket 10 at a goods carrier, not shown, and thus to offer it for sale to a customer.

A plurality of cut-outs 42*a*, 42*b* to 52*a*, 52*b* extending into the respective side wall 16, 18 are formed at an upper margin 40*a*, 40*b* of each side wall 16, 18 to receive one or more shelf elements. The first cut-outs 42*a*, 42*b* form an essentially rectangular groove and are arranged in a rear end region of the shelf bracket 10. The second cut-outs 44*a*, 44*b*, 48*a*, and 48*b* are arranged along the upper margin 40*a*, 40*b* substantially after one third and after two thirds of the total length of the shelf bracket, are formed identically to one another, and each have an undercut 45*a*, 45*b*, 49*a*, 49*b*. The undercuts 45, 49 serve, for example, to hold a shelf bottom or a wire grid bottom in a shape-matched manner in the cut-out 44, 48. The third cut-outs 46*a*, 46*b*, 50*a*, 50*b* are formed by slits extending perpendicular from above into the side wall 16, 18. In this respect, the cut-outs 46 are arranged substantially centrally, i.e. spaced apart equally from the front end 14 and from the rear end 12 of the shelf bracket 10 and the cut-outs 50 are arranged in a front end region of the shelf bracket 10. The cut-outs 52 are formed at the front end 14 and are open to the top and to the front. The cut-outs 52 thus have a step-shaped outline in a side view (FIG. 1A).

Shelf elements such as steel compartment bottoms can be placed in a shape-matched manner into the cut-outs 42, 46, and 52.

Furthermore, a rectangular hole 54*a*, 54*b* that extends in the longitudinal direction of the shelf bracket is formed in each of the side walls 16, 18. The holes 54*a*, 54*b* are formed at the shelf bracket 10 in alignment with one another. Together with the slit-shaped cut-outs 50*a*, 50*b* formed at the upper margin 40*a*, 40*b* in the front end region of the shelf bracket, the holes 54*a*, 54*b* serve as coupling means for a guide rail 56 to be fastened to the shelf bracket 10.

The guide rail 56 is shown more precisely in FIGS. 3A to 4. The guide rail 56 has a rear end 70, a front end 72, and a side wall 74. As can be seen in FIG. 3D, a lower guide rail section 76 and an upper guide rail section 78 project perpendicular from the side wall 74 of the guide rail 56. The guide rail 56 hereby has a C-shaped cross-section at least sectionally.

A first hook section 80 that extends to the rear is bent outwardly, i.e. in the opposite direction to the guide rail sections 76, 78, out of the side wall 74 in a rear region of the guide rail 56. A front rail section 82 projects upwardly over the upper guide rail section 78 in a front region of the guide rail 56. A second hook section 84 projects from the front rail section 82 in the region of an upper front corner of said front rail section and is likewise bent over outwardly, but extends to the front.

First part sections 80*a*, 84*a* of the hook sections 80, 84 each extend away from the outer side of the side wall 74 and second part sections 80*b*, 84*b* then extend substantially in parallel with the side wall 74, but in opposite directions (FIG. 3B). The second part section 80*b* of the first hook section 80 therefore extends to the rear and the second part section 84*b* of the second hook section 84 extends to the front.

The first hook section 80 and the second hook section 84 form a push-lock connection with the cut-out 54*a* (FIG. 1A) and the slit 50*a* of the shelf bracket 10 so that the guide rail 56 is fastenable to the shelf bracket 10 without tools, as is shown in FIGS. 5A to 6. For this purpose, the outer side of the side wall 74 of the guide rail 56 is placed onto the outer side of the side wall 16 of the shelf bracket 10 such that the first hook section 80 engages into the cut-out 54*a* of the shelf bracket 10. The guide rail 56 is then displaced in the direction of the rear end 12 of the shelf bracket 10 relative to the shelf bracket 10 so that the hook section 80 engages behind the first side wall 16 and a part of the side wall 16 is located between the second part section 80*b* and the side wall 74 of the guide rail 56. The spacing between the hook sections 80, 84, more precisely the spacing between the first part sections 80*a*, 84*a* of the hook sections 80, 84 is dimensioned such that the part section 84*a* of the second hook section 84 of the guide rail 56 can be pushed into the slit 50 with the first hook section 80 already engaging into the shelf bracket 10. In other words, the first hook section 80 can first be pushed into the cut-out 54*a* until the side wall 16 of the shelf bracket 10 is located between the part section 80*b* and the side wall 74 of the guide rail 56 and the second hook section 84 can subsequently be hung from above into the slit 50 of the shelf bracket 10.

As can in particular be seen in FIG. 5A, the upper guide rail section 78 of the guide rail 56 is substantially located beneath the upper margin 40, i.e. approximately one third of the total height of the shelf bracket 10, in the installed state. It is hereby possible to fasten the guide rail 56 and additionally a further shelf element such as a wire bottom, a wooden bottom, or a steel compartment bottom at a side of the shelf bracket 10.

The guide rail 56 furthermore has a roller 86 (FIG. 3A) that is arranged at the inner side of the guide rail 56 in a front end region of the guide rail 56. The roller 86 is rotatably supported about an axis of rotation 88 that is aligned perpendicular to the plane of the side wall 74.

The guide rail 56 serves, in conjunction with a mirrored second guide rail 56' (FIG. 6B), for the displaceable support of a shelf element 90 such as the trouser holder 90 shown in FIG. 8, a wooden bottom, a wire basket, or a tray. To be able to pull it out and push it in with as low a friction as possible, a pull-out rail 92 (FIGS. 7A to 7D) is releasably or unreleasably fastened to the shelf element 90 at the left and a mirrored pull-out rail 92' at the right. The pull-out rail 92 has an upper pull-out rail section 94 whose inner side 94*a* (FIG. 7*c*) is in contact with a peripheral surface 86*a* of the roller 86 of the guide rail 56 (FIGS. 3A to 3D) and on whose inner side 94*a* the roller 86 of the guide rail 56 rolls off on the pulling out and pushing in of the shelf element 90. A roller 96 that is rotatably supported about an axis of rotation 98 that is aligned perpendicular to a plane of a side wall 100 of the pull-out rail 92 is likewise attached to the pull-out rail 92. The peripheral surface 96*a* of the roller 96 of the pull-out rail 92 lies on an inner side 76*a* (FIG. 3A) of the lower guide rail section 76 in the assembled state and rolls off on the inner side 76*a* of the lower guide rail section 76 on the pulling out and pushing closed of the shelf element 90.

To define a pushed-in state of the shelf element 90, a bulge 102 is provided at the inner side 76 of the lower guide rail section 76 into which bulge the roller 96 of the pull-out rail 92 can roll and is thereby held in a defined position. Furthermore, a push-in abutment 104 shaped from an elastomer is provided at the outer side of the front end 72 of the guide rail 56 and comes into contact with a front end wall 106 (FIG. 7C) of the pull-out rail 92 when the defined pushed-closed state of the shelf element 90 has been reached, So that the pull-out rail 92 cannot be pulled out by more than a defined pull-out distance, the rollers 86, 96 are arranged so that they limit a pulling out of the pull-out rail 92 by a mutual abutment of one another. The rollers 96, 96 are disposed for this purpose in the installed state in overlapping height regions and depth regions. A pull-out block is hereby defined by which it is prevented that the shelf element 90 together with the pull-out rail 92 is unintentionally released from the guide rail 56.

Two mounts 58, 60 for a respective one clothes rail holder 62 (FIG. 9A to 10) are shaped in a front half in the bracket bottom 20 of the shelf bracket 10 (FIG. 1B). Each mount 58, 60 is formed by two slits 58*a*, 58*b* and two openings 58*c*, 58*d*. To fasten the clothes rail holder 62 to the shelf bracket 10, hook-shaped upper end sections 64*a*, 64*b* of the clothes rail holder 62 are introduced into the slits 58*a*, 58*b* from below, the clothes line holder is displaced to the front in the direction of the openings 58*c*, 58*d*, and the clothes line holder 62 is pulled downward so that front end sections 64*c*, 64*d* of the hook-shaped upper end sections 64*a*, 64*b* engage into the openings 56*c*, 58*d*.

The clothes rail holder 62 comprises a hook-shaped clothes rail mount or tube mount 108 for receiving a clothes rail, not shown. Two inwardly directed elevated portions 110, 112 are pressed in an end section of the tube mount 108 and secure a clothes rail held by the clothes rail holder 62. To insert the clothes rail into the clothes rail holder 62, the former is clipped into the tube mount 108 over the elevated portions 110, 112. A connection section 114 that is formed in the shape of a single twisted metal sheet is provided between the tube mount 108 and the hook-shaped upper end sections 64*a*, 64*b*. This embodiment of the clothes rail holder 62 has the advantage that the clothes rail holder 62 can be shaped inexpensively from a metal sheet.

Two openings 66, 68 are furthermore provided in the bracket bottom 20 of the shelf bracket 10 (FIG. 1B) through which screws can be led, for example for screwing together a wooden shelf bottom.

The shelf bracket 10 can also be called a universal support due to its above-described different functions that comprise the mounting of shelf bottoms, the mounting of guide rails for shelf elements that can be pulled out, and the mounting of clothes rail holders and due to the universal applicability resulting therefrom.

REFERENCE NUMERAL LIST

10 shelf bracket
12 rear end of the shelf bracket
14 front end of the shelf bracket
16 first side wall of the shelf bracket
18 second side wall of the shelf bracket
20 bracket bottom
21 web section of the T-shaped end section
22 T-shaped end section
23 hook section of the T-shaped end section
24 wall rail or wall strip
26 slit-shaped hole of the wall rail
28 grid dimension
30 maximum height of the T-shaped end section
32 length of the slit-shaped hole of the wall rail
34 pin
36 second slit-shaped hole of the wall rail
38 hanging hole
40 upper margin of the shelf bracket
42 cut-out
44 cut-out
45 undercut
46 cut-out
48 cut-out
49 undercut
50 cut-out
52 cut-out
54 hole
56 guide rail
58 mount
58*a*, 58*b* slits
58*c*, 58*d* openings
60 mount
62 clothes rail holder
64*a*, 64*b* hook-shaped upper end sections
64*c*, 64*d* front end sections
66 opening
68 opening
70 rear end of the guide rail
72 front end of the guide rail
74 side wall of the guide rail
76 lower guide rail section
76*a* inner side of the lower guide rail section
78 upper guide rail section
80 first hook section
80*a* first part section
80*b* second part section
82 front rail section
84 second hook section
84*a* first part section
84*b* second part section
86 roller of the guide rail
86*a* peripheral surface of the roller
88 axis of rotation of the roller
90 shelf element
92 pull-out rail
94 upper pull-out rail section
94*a* inner side of the upper pull-out rail section
96 roller of the pull-out rail
96*a* peripheral surface of the roller
98 axis of rotation of the roller
100 side wall of the pull-out rail
102 outer arch
104 push-in abutment
106 front wall of the pull-out rail
108 tube mount
110 elevated portion for the tube clamping or tube fixing
112 elevated portion for the tube clamping or tube fixing
114 connection section

The invention claimed is:

1. A wall shelf system comprising:

a shelf bracket having a rear end configured to be fastened to a wall rail, having a front end, and having at least one first side wall; and a guide rail for a shelf element that can be pulled out, the guide rail having a rear end, a front end, and at least one side wall, wherein coupling means are provided at the shelf bracket; and wherein coupling means corresponding to the coupling means of the shelf bracket are provided at the guide rail to releasably fasten the guide rail to the shelf bracket, wherein the coupling means of the shelf bracket comprise two cut-outs, with one of the cut-outs being formed by a hole in the side wall of the shelf bracket and with the other cut-out being formed by a slit that extends from an upper margin of the shelf bracket into the shelf bracket; and wherein the coupling means of the guide rail comprise at least two hook sections corresponding to the cut-outs.

2. The wall shelf system in accordance with claim 1, wherein the coupling means of the shelf bracket are arranged at the side wall of the shelf bracket.

3. The wall shelf system in accordance with claim 1, wherein the coupling means of the guide rail are arranged at the side wall of the guide rail.

4. The wall shelf system in accordance with claim 1, wherein the coupling means of the shelf bracket are arranged at the side wall of the shelf bracket and wherein the coupling means of the guide rail are arranged at the side wall of the guide rail.

5. The wall shelf system in accordance with claim 1, wherein the coupling means of the shelf bracket and the coupling means of the guide rail enable a shape-matched connection between the shelf bracket and the guide rail.

6. The wall shelf system in accordance with claim 1, wherein the coupling means of the shelf bracket are formed in the side wall of the shelf bracket and the coupling means of the guide rail project from the side wall of the shelf bracket.

7. The wall shelf system in accordance with claim 1, wherein the coupling means of the shelf bracket and the coupling means of the guide rail enable a fixing and release of the guide rail without tools.

8. The wall shelf system in accordance with claim 1, wherein the coupling means of the shelf bracket and the coupling means of the guide rail enable a push-lock connection between the guide rail and the shelf bracket.

9. The wall shelf system in accordance with claim 1, wherein coupling means are provided at each of the side walls of the shelf bracket to respectively fasten a guide rail thereto.

10. The wall shelf system in accordance with claim 1, wherein the shelf bracket has a security against removal at its rear end.

11. The wall shelf system in accordance with claim 10, wherein the security against removal comprises a T-shaped end section.

12. The wall shelf system in accordance with claim 1, wherein at least one mount for a clothes rail holder is provided at the shelf bracket.

13. The wall shelf system in accordance with claim 12, wherein a clothes rail holder is provided that can be connected to the shelf bracket without tools.

14. The wall shelf system in accordance with claim 1, wherein the guide rail has a C-shaped cross-section.

15. The wall shelf system in accordance with claim 1, wherein the guide rail has a pull-out block at its front end region.

16. The wall shelf system in accordance with claim 15, wherein the pull-out block is in the form of a roller.

* * * * *